US005934584A

United States Patent [19]

Schwelling

[11] Patent Number: 5,934,584

[45] Date of Patent: Aug. 10, 1999

[54] BASE FRAME FOR PAPER COMMINUTING DEVICES

[76] Inventor: Hermann Schwelling, Hartmannweg 5, 88682 Salem, Germany

[21] Appl. No.: 08/949,088

[22] Filed: Oct. 10, 1997

[30] Foreign Application Priority Data

Oct. 11, 1996 [DE] Germany ..... 196 41 933

[51] Int. Cl.[6] ..... A47B 47/00

[52] U.S. Cl. ..... 241/285.1; 160/73; 312/326; 312/329; 241/100

[58] Field of Search ..... 241/236, 100, 241/285.1, 285.2; 312/329, 326; 160/73; 220/4.28, 6, 7, 682, 691

[56] References Cited

U.S. PATENT DOCUMENTS

| | | | |
|---|---|---|---|
| 3,409,202 | 11/1968 | Belcher | 229/23 |
| 4,998,637 | 3/1991 | Moravski | 220/6 |
| 5,269,473 | 12/1993 | Strohmeyer et al. | 241/100 |
| 5,348,549 | 9/1994 | Brown et al. | 604/403 |
| 5,375,781 | 12/1994 | Schwelling | 241/100 |
| 5,429,313 | 7/1995 | Schwelling | 241/36 |
| 5,597,084 | 1/1997 | Parasin | 220/4.28 |
| 5,678,717 | 10/1997 | Hsu | 220/4.28 |
| 5,788,347 | 8/1998 | Rabinovitz | 312/111 |

*Primary Examiner*—Joseph J. Hail, III
*Assistant Examiner*—William Hong
*Attorney, Agent, or Firm*—Friedrich Kueffner

[57] ABSTRACT

A paper comminuting device or similar device, such as a paper shredder, is composed of two dimensionally stable side components extending parallel to each other and a bottom and a rear wall connecting the side components, and a cutting mechanism housing releasably placed on the side components and the rear wall. The rear wall and the bottom of the base frame are manufactured from an initially single-piece, planar plate with a transversely extending bending groove between the areas of the bottom and the rear wall. When the base frame is assembled, the appropriately profiled side components are connected to the plate and hold the plate in an angular position of 90 degrees. The side components are connected through insertable connecting points to the cutting mechanism housing so as to form together with the cutting mechanism housing a rigid, box-like component, wherein the connecting points are arranged in at least two planes located at a vertical distance from each other.

6 Claims, 2 Drawing Sheets

4a
4b
PL
4
BN
3b
3
3a

4b
AK
4a
4
90°
BN
3
3a
3b

BASE FRAME FOR PAPER COMMINUTING DEVICES

BACKGROUND OF THE INVENTION

1. Field of the Invention

The present invention relates to a paper comminuting device or similar device, such as a paper shredder, composed of two dimensionally stable side components extending parallel to each other and a bottom and a rear wall connecting the side components, and a cutting mechanism housing releasably placed on the side components and the rear wall.

2. Description of the Related Art

Open base frames which have been known in the past either have no base plate connecting the side components, which may lead to contamination of the office floor because of cut particles, or the base frames are rigid, box-like structures of different types which not only require a large amount of space for storage and transportation, but additionally frequently are complicated and, thus, are expensive to manufacture and/or assemble.

SUMMARY OF THE INVENTION

Therefore, it is the primary object of the present invention to provide a base frame of the above-described type which is simple to manufacture and assemble and which eliminates the disadvantages of known embodiments discussed above.

In accordance with the present invention, the rear wall and the bottom of the base frame are manufactured from an initially single-piece, planar plate with a transversely extending bending groove between the areas of the bottom and the rear wall. When the base frame is assembled, the appropriately profiled side components are connected to the plate and hold the plate in an angular position of 90 degrees. The side components are connected through insertable connecting points to the cutting mechanism housing so as to form together with the cutting mechanism housing a rigid, box-like component, wherein the connecting points are arranged in at least two planes located at a vertical distance from each other.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
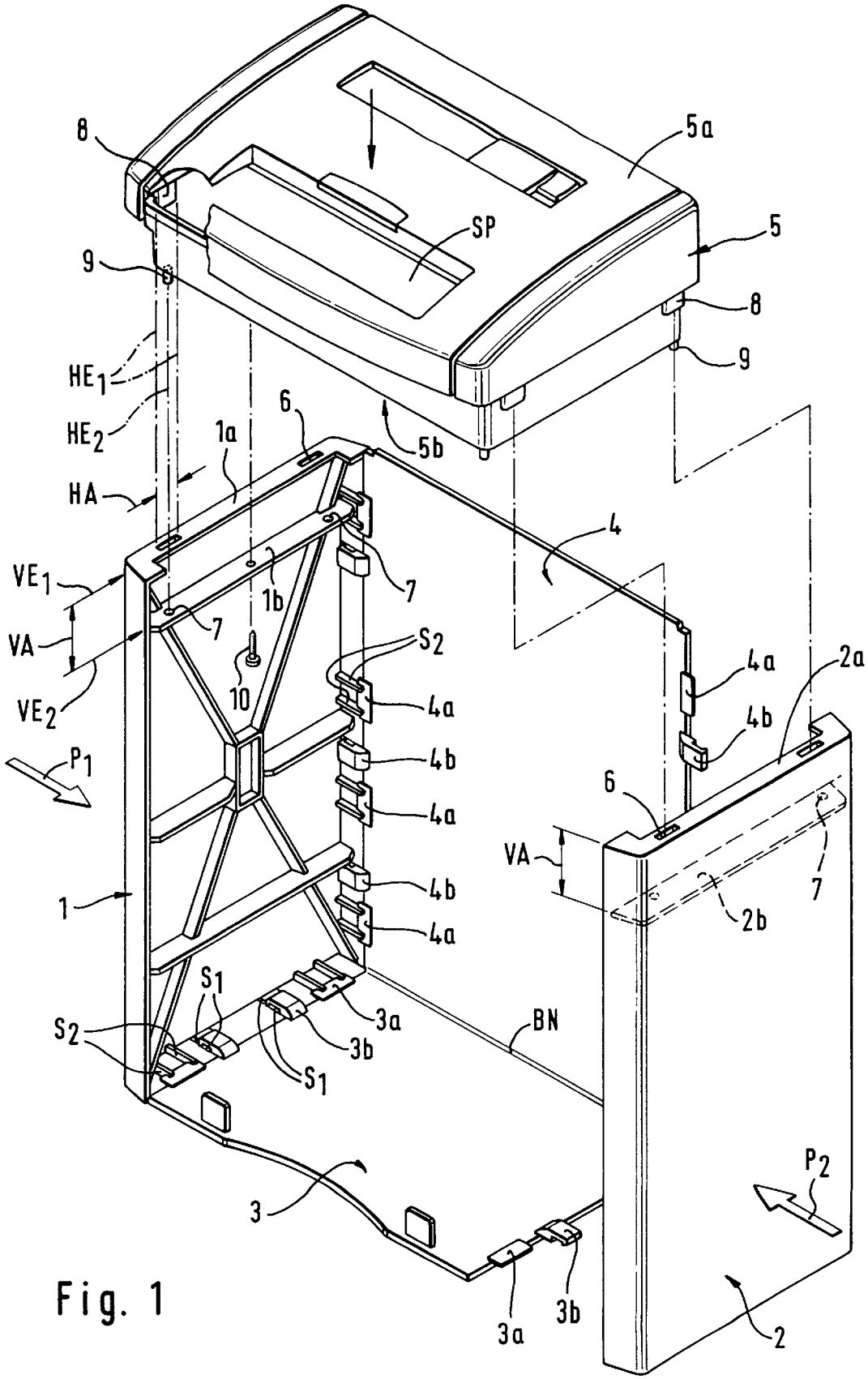
FIG. 1 is a perspective exploded view of the base frame for a paper shredder according to the present invention.

As illustrated in FIG. 1, the base frame according to the present invention is composed basically of two dimensionally stable side components 1 and 2 which extend parallel to each other. A bottom 3 and rear wall 4 connect the side components 1 and 2. The base frame is completed by a cutting mechanism housing releasably placed on the rear wall 4 and the side components 1, 2.

Figure 2:
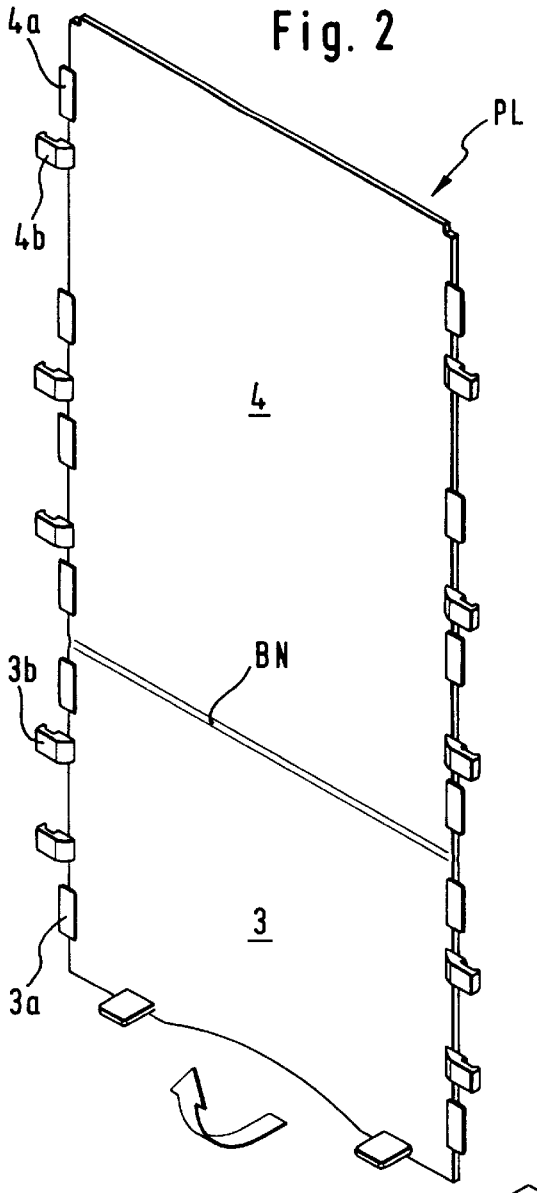
FIG. 2 is a perspective view of the plate forming the rear wall and the bottom of the base frame shown in the initial position.
Figure 3:
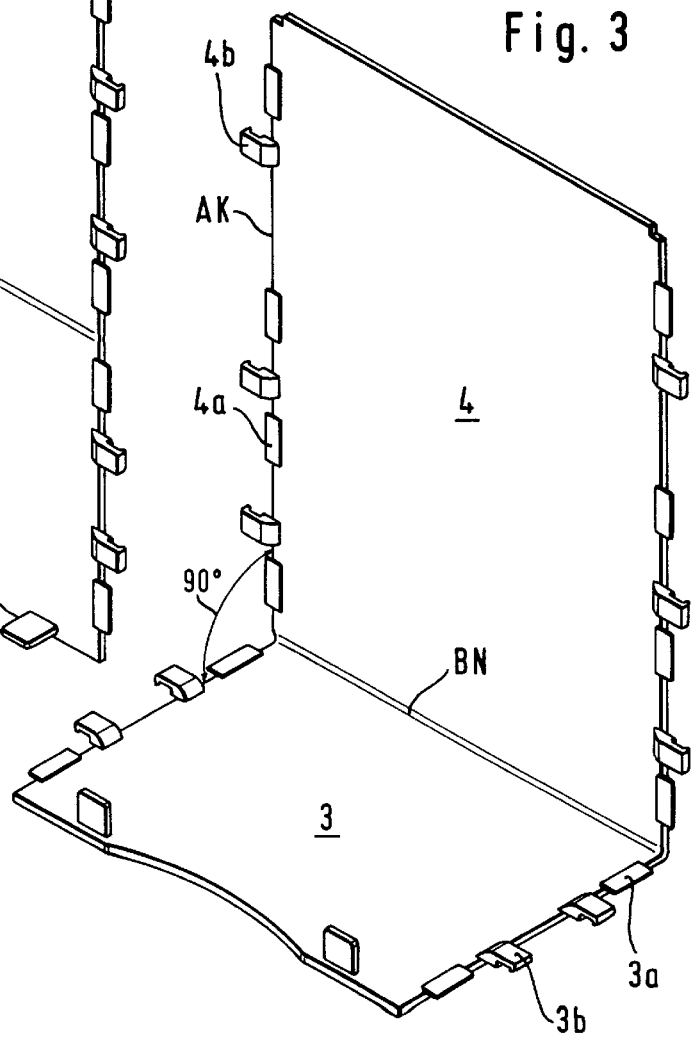
FIG. 3 is a perspective view of the plate of FIG. 2 in the assembly position.

In accordance with the present invention, the rear wall and the bottom 3 are composed of an initially single-piece planar plate PL, shown in FIG. 2, with a transversely extending bending groove BN between the areas forming the bottom 3 and the rear wall 4. For assembling the base frame, the plate PL is bent into the position shown in FIG. 3, i.e., the bottom 3 and rear wall 4 form an angle of 90 degrees between each other. In this position, the side components 1 and 2 are connected to the plate PL. Finally, the side components 1 and 2 are connected to the cutting mechanism housing 5 to form a rigid, box-like component, wherein the connection is effected by means of connecting points 6 and 7 arranged in at least two planes $VE_1$ and $VE_2$ located at a vertical distance VA relative to each other.

A particularly advantageous and simple manufacture, primarily as an injection molded part of synthetic material, is possible by constructing the insertion elements 3*a*, 3*b* and 4*a*, 4*b* of the bottom and rear wall areas 3 and 4 of the plate PL as planar insertion lugs 3*a* and 4*a* and/or hook-shaped snap-type closures 3*b* and 4*b* without undercuts. By continuously arranging the insertion elements and snap-type connectors 3*a*, 3*b*, and 4*a*, 4*b* in an alternating manner at the outer edges AK of the bottom and rear wall plate 3 and 4 which face the dimensionally stable side components 1 and 2, a rigid and always operationally safe connection is effected between the three loose planar initial components 1, 2 and PL.

The absolute static stability in the finished state of the base frame according to the present invention is additionally achieved in that the connecting points 6, 7 and 8, 9 for the cutting mechanism housing 5, in addition to being located in the vertically spaced apart planes $VE_1$ and $VE_2$, are also arranged offset, as indicated at HA, in the horizontal planes $HE_1$, and $HE_2$ at each side component 1 and 2. In a special configuration of these connecting points 6 through 9 for the cutting mechanism housing 5, ribs 1*a*, 1*b* and 2*a*, 2*b* provided at the side components 1 and 2 are provided with recesses 6 and 7 and corresponding pins 8 and 9 of any cross-sectional configuration are formed at the bottom side 5*b* of the cutting mechanism so as to effect a positively engaging connection.

In accordance with another useful feature, an additional frictionally engaging securing element 10 is provided advantageously also in the area of the ribs 1*b* and 2*b* between the cutting mechanism housing 5 and each side component 1 and 2 for preventing the cutting mechanism from being lifted off.

Additionally shown in the drawing are arrows $P_1$ and $P_2$ indicating the direction in which the side components 1 and 2 are inserted onto the plate PL. Connectors $S_1$ and $S_2$ are provided for engaging the connectors 3*a*, 4*a*, 3*b*, 4*b*. In addition, the cutting mechanism housing 5 is provided in its upper side 5*a* with an intake slot SP.

The invention is not limited by the embodiments described above which are presented as examples only but can be modified in various ways within the scope of protection defined by the appended patent claims.

I claim:

1. A base frame in combination with a cutting mechanism housing for paper comminuting devices, the base frame comprising two dimensionally stable side components extending parallel to each other, a bottom and a rear wall connecting the side components, wherein the cutting mechanism housing is releasably placed on the rear wall and the side components, wherein the rear wall and the bottom are comprised of a single-piece initially planar plate having a transversely extending bending groove between a bottom portion and a rear wall portion of the plate, the side components being connectable to the plate in a position of the plate in which the bottom portion and the rear wall portion extend at an angle of 90 degrees relative to each other, further comprising insertable connecting means for connecting the cutting mechanism housing to the side components so as to form a rigid box-like component with the cutting mechanism housing, wherein the connecting means are located in planes extending at a vertical distance relative to each other.

2. The base frame according to claim 1, wherein the means for connecting the side components to the bottom portion and the rear wall portion of the plate comprise at least one of planar insertion lugs and hook-shaped snap-type closures without undercuts.

3. The base frame according to claim 2, wherein the bottom portion and the rear wall portion of the plate have outer edges facing the side components, and wherein the insertion lugs and the hook-shaped snap closures are arranged alternatingly along the outer edges.

4. The base frame according to claim 1, wherein the connecting means between the cutting mechanism housing and the side components are additionally spaced apart in horizontal planes at each side component.

5. The base frame according to claim 1, wherein the connecting means between the cutting mechanism housing and the side components comprise ribs mounted on the side components and recesses formed in the ribs and pins provided at a bottom side of the cutting mechanism housing for engaging in the recesses of the ribs in a positively engaging manner.

6. The base frame according to claim 1, further comprising an additional frictionally engaging connecting element between the cutting mechanism housing and each side component.

* * * * *